United States Patent [19]

Kurner

[11] 4,029,011

[45] June 14, 1977

[54] MULTI COLOR WELLS PROCESS

[76] Inventor: Ebbert Franklin Kurner, 2500 NE. 192 St., N. Miami, Fla. 33180

[22] Filed: May 16, 1975

[21] Appl. No.: 578,160

[52] U.S. Cl. ..... 101/330; 101/203 A; 101/208; 101/327; 401/218

[51] Int. Cl.[2] ..... B41K 1/22; B41K 1/46; B41K 1/54

[58] Field of Search ..... 401/218; 101/211, 203, 101/205–208, 327–331

[56] References Cited

UNITED STATES PATENTS

| | | | |
|---|---|---|---|
| 158,014 | 12/1874 | Baldwin | 101/329 |
| 272,443 | 2/1883 | Ingersoll | 101/406 |
| 291,969 | 1/1884 | Whitehead | 101/203 A |
| 986,530 | 3/1911 | Wild | 101/203 A |
| 1,101,395 | 6/1914 | Bobbit | 101/79 |
| 2,630,592 | 3/1953 | Sultanik et al. | 401/218 |
| 2,753,641 | 7/1956 | Dorman | 101/208 |
| 3,134,327 | 5/1964 | Sebanc | 401/218 |
| 3,408,932 | 11/1968 | Mucci | 101/368 |

FOREIGN PATENTS OR APPLICATIONS

| | | | |
|---|---|---|---|
| 837,530 | 2/1939 | France | 101/331 |
| 583,783 | 12/1946 | United Kingdom | 101/330 |

*Primary Examiner*—Edgar S. Burr
*Assistant Examiner*—William Pieprz

[57] ABSTRACT

A device for applying multi-color designs to wall surfaces or other areas is disclosed. A hand-held paint applying device is utilized in rolling contact with the area to be decorated. The applying device includes a design carrying roller in peripheral contact with an inking roller. The inking roller surface is divided into discrete areas each containing a different color ink (or paint). The application of ink to the various discrete areas on the inking roller is accomplished by means of a color pad (or tray) having its interior divided into corresponding discrete areas to enable the ink roller to be rolled thereover, whereby each different area on the ink roller will consistantly be inked with a predetermined color ink (or paint) contained in the corresponding discrete area in the ink pad.

1 Claim, 2 Drawing Figures

MULTI COLOR WELLS PROCESS

Figure 2:
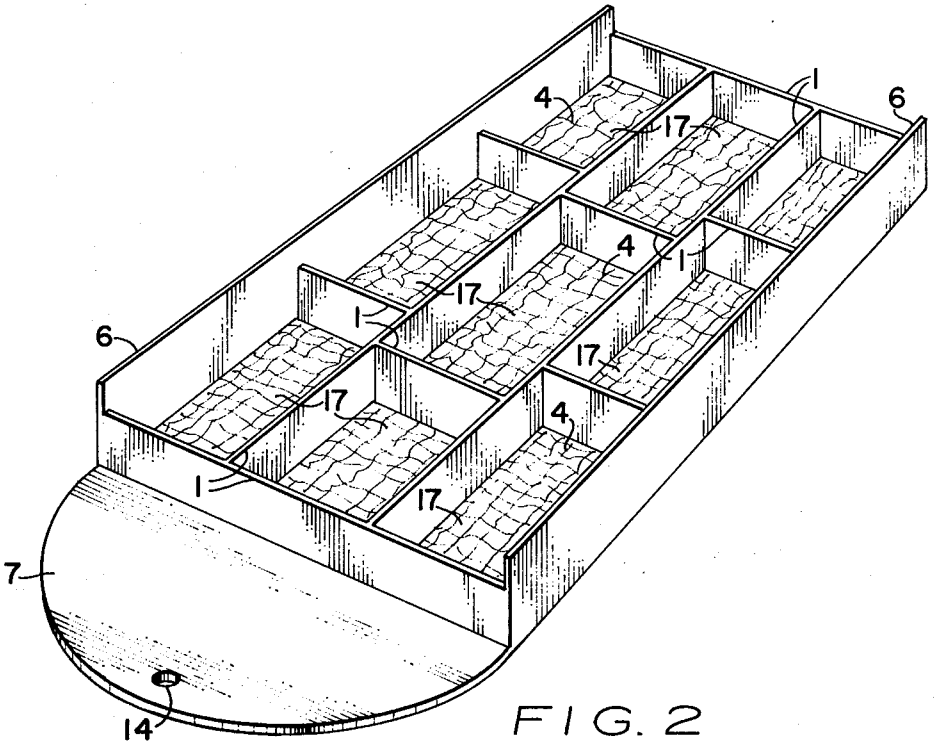

This invention relates to a multi color wells process. The primary object of this invention is to provide a multi color printing process which comprises a design roller unit and a multi color wells tray. Said multi color wells tray having nine or more paint receiving compartments therein, each having different colors of printing substance such as ink or latex paint all these colors being transferred from the wells by the slotted color pad contacts on the color pad constructed of foam rubber or other substance. Said multi color wells compartments are in matching relation with the color pad contacts on the inking roller of the design roller unit, which allows the wells partitions to enter into the slots bordering each color pad contact and permits a separation of the colors from each other forming a color barrier. Thus when the color pad contacts match up in fluid contact with the design roller the different colors will be transferred to the design roller for a matching relation and upon further rotation of said rollers, the design in multi color is applied to the wall, ceiling, or cloth or other objects to be printed.

The color pad and the color pad contacts consist of an absorbant material such as foam rubber or other absorbing materials. The color pad contacts absorbs the latex paint or other printing liquid from the multi color wells and the printing liquid will not drip the color pad contacts when used in any position and will not permit the intermixture of colors from the multi color wells tray. Such intermixture of course be undesirable when each well contains a different color printing liquid as used in multi color printing for which the multi color wells process is particularly adaptable. The design roller and said color pad contacts roller being positioned side by side with its longitudinal axis therefore parallel to each other and with the outer surface of said color pad contacts in fluid transfer contact with said design roller. The design roller and said color pad contacts roller being rotably supported by said support means for rotation about their longitudinal axes, the provided notch marks 5 and 8 are stationary and are movable therewith relatively, on one side of the color pad contacts roller and on one side of the design roller and serve a multi purpose, for starting in the color wells and for stopping at the end of the color wells and for the purpose of lining up the different colors from the color wells 17 on to the color pad contacts 9 and from the color pad contacts 9 and by fluid color contact to a matching spot on the design roller pattern 10, the notch mark on one side only indicates the design roller pattern 10 to be right side up when printing the notch mark 8 was provised so notch mark 5 would not be viewed as a color pad contact slot only.

To make this invention more clearly understood reference will now be made to accompanying drawings which are given by way of example only and in which FIG. 1. is a perspective view of the design carrying Unit embodying the present invention.

FIG. 2 is a perspective view of the multi color wells tray.

Figure 1:
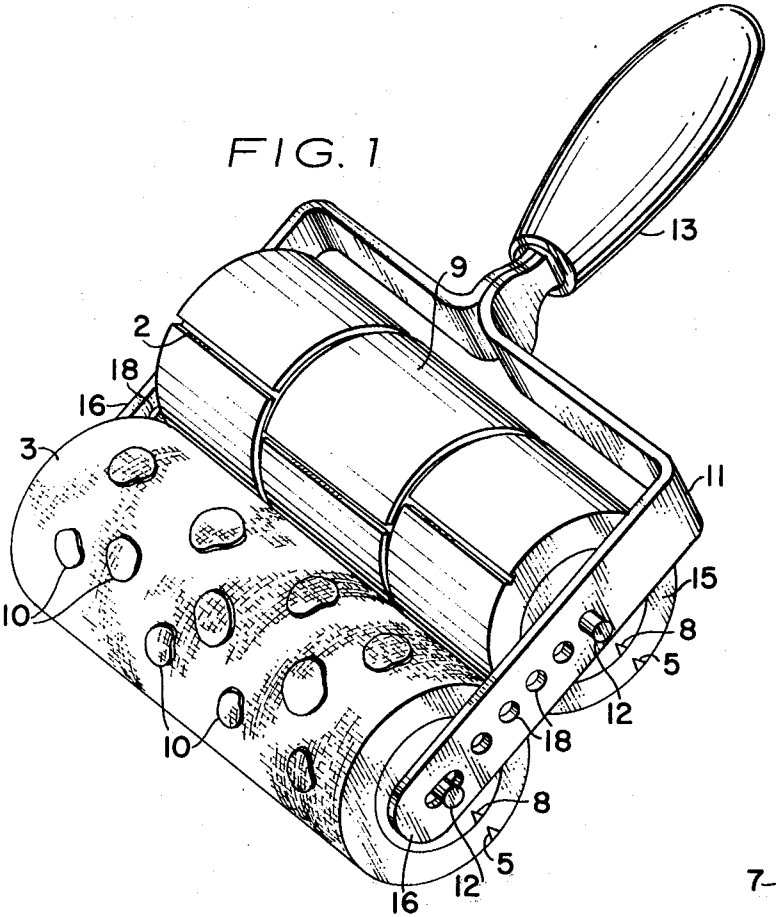

I have shown in FIG. 1 a design carrying roller 3 a color pad roller 15 color pad contacts 9 having slots 2 bordering the color pad contacts. The design holder 11 consists of a yoke having two arms 16 with a plurality of apertures 18 provided in outstanding portions of each arm 16 and it will be seen that design roller 3 and color pad contacts roller 15 are rotatably supported by arms 16 and pins 12. The notch marks 8 and 5 appear on one side only, on the design roller 3 and on the color pad contacts roller 15.

Turning now to FIG. 2 there shown the multi color wells tray comprising a base 7 having thin partitions 1 thereon, 9 or more paint receiving color wells 17 half filled with ink or latex paint or other printing substance, color pad contacts roller guide 6 is provided at both sides of the multi color wells. At 14 there shown a nail hole for hanging when not in use. And 4 showing rough textured base with the partitions thereon which give assurance of the different colors not mixing with each other. In operation the color wells 17 and the color pad contacts slots 2 matching the color wells partitions 1 and the color pad contacts corresponding to the wells, the design roller and the color pad contacts roller are positioned side by side for rotation about the longitudinal axes of the design roller 3 and the color pad contacts roller 15 respectively by means of pins 12 which are connected to rollers 3 and 15 as shown in FIG. 1. The design roller 3 has a pattern 10 on the peripheral surface thereof. The design roller 3 may be constructed of any suitable slightly resilient plastic or rubber for example. The design roller 3 and color pad contacts roller 15 are positioned side by side with the longitudinal axes thereof parallel to each other and with the outer surfaces of the color pad contacts 9 in liquid transfer contact with the design roller. Both rollers 3 and 15 are of the same diameter this being required where it is desirable to achieve uniformity of the color on the design pattern 10 and the color which may be printed by the holder unit in FIG. 1.

In the operation of the multi color wells process embodying my invention the design roller 3 and the color pad 15 containing color pad contacts 9 on its outer surface are mounted in holder 11 as shown in FIG. 1. The rollers are removed for example by spreading holder 11 at 16. The exposed paint receiving wells 17 are each partly filled with paint of different colors. The color pad contacts roller then is placed at 12 near the handle 13 in holder 11. The color pad 15 containing the color pad contacts 9 then is placed in the color wells at the starting notch mark 5 and 8 and the color pad contacts slots 2 are placed over the wells partitions 1 and the partitions entering into the color pad contacts slots 2, one can then revolve the color pad contacts roller 15 by pulling handle 13 with a downward motion until the color pad contacts roller reaches the end of the color wells partitions 1 then lifting from the color wells, spreading the holder 11 at 16 and inserting the design roller of the same overall dimentions as the color pad contacts roller making sure the notch on both rollers line up together. Then the design containing unit in FIG. 1 is ready for printing thus producing a plurality of intermingled colors. For refilling spread the holder 11 at 16 remove the design roller and repeat the same operation. The design pattern is set by sight some designs require rotation: which means the operator selects an obvious point on the design roller one time the point faces the operator and the next time the designs away from the operator.

In printing a sign "For Rent" the word "For" can be in blue and the word "Rent" can be in red or each letter can be in a different color by having a matching color well and a matching slotted color pad contact for each partitioned color well and all in matching relationship with each other. The notch marks line up the different colors so the color always comes in contact with the same part of the surface during each revolution and thus the colors are printed in multi color in one operation. It will also be seen that my design unit in FIG. 1 is easy to manenver and light in weight comprising two light weight rollers and in FIG. 2 a multi color wells tray.

Having thus described my invention what I claim as new and desire to secure by letters patent is:

1. A multi color printing apparatus including in combination:

a. a multi color ink tray having parallel end and side walls defining a rectangularly shaped closed area, a floor extending normal to said end and side walls, and a plurality of partitions extending normal to said floor and extending longitudinally and transversly within said closed area, said partitions, floor, end and side walls defining closed sub areas, said sub areas comprising printing ink compartments which contain printing ink, the ink in some of said compartments being of different color than the ink in other said compartments;

b. a cylindrical color pad roller having a surface layer composed of a foam-like ink retentive and ink absorbant material and having the periphery thereof divided by slots therein into a plurality of discrete areas, such that when said surface layer is developed onto a plane, said discrete areas correspond in size, shape and relative location with said sub-areas of said ink tray;

c. a cylindrical design roller having a design pattern upon the cylindrical surface thereof and having the same diameter and length as the color pad roller;

d. means for removably positioning said design roller and said color pad roller in side by side relationship with their longitudinal axes parallel to each other and with their outer surfaces in ink-transfering and rotation-transmitting contact with each other, said positioning means supporting each of said rollers for rotation about their longitudinal axes;

e. each of said design and color pad rollers being provided with notch marks on one end face thereof so that by alignment of said notch marks prior to rotation of the respective rollers, each spot on the periphery of said design roller will, upon rotation of said rollers, contact a predetermined spot on said color pad roller to ensure that the different color inks absorbed in said discrete areas of said color pad roller are constantly transferred to the same design areas;

f. whereby upon rotation of said color pad roller over, and in contact with said compartments, said ink tray compartments are operative to cooperate with said color pad slots and discrete areas respectively, to consistantly transfer a predetermined color ink contained in said compartments to said discrete areas; and g. whereby upon rotation of said design roller periphery in contact with a workpiece the color pad roller will rotate in contact with said design roller and transfer ink to said design roller which will inturn transfer said ink to said workpiece.

* * * * *